US010446900B2

(12) United States Patent
Ouchi

(10) Patent No.: US 10,446,900 B2
(45) Date of Patent: Oct. 15, 2019

(54) DIELECTRIC WAVEGUIDE-PATH DEVICE

(71) Applicant: Kazuyuki Ouchi, Hyogo (JP)

(72) Inventor: Kazuyuki Ouchi, Hyogo (JP)

( * ) Notice: Subject to any disclaimer, the term of this patent is extended or adjusted under 35 U.S.C. 154(b) by 0 days.

(21) Appl. No.: 15/358,465

(22) Filed: Nov. 22, 2016

(65) Prior Publication Data

US 2017/0155180 A1 Jun. 1, 2017

(30) Foreign Application Priority Data

Nov. 26, 2015 (JP) ..... 2015-230494

(51) Int. Cl.
*H01P 3/16* (2006.01)
*H01P 5/18* (2006.01)
*H01Q 1/00* (2006.01)

(52) U.S. Cl.
CPC ..... *H01P 3/16* (2013.01); *H01P 5/188* (2013.01); *H01Q 1/00* (2013.01)

(58) Field of Classification Search
CPC ... H01P 3/16; H01P 5/08; H01P 5/188; H01Q 1/00
USPC ..... 333/239
See application file for complete search history.

(56) References Cited

U.S. PATENT DOCUMENTS

2013/0301983 A1* 11/2013 Mazumder ..... G02B 6/1226 385/16

FOREIGN PATENT DOCUMENTS

JP 5732247 B2 6/2015

OTHER PUBLICATIONS

Mendes, et al., "Planar dielectric waveguides", Department of Physics & Astronomy website, University of Louisville, KY, Jul. 18, 2010, pp. 1-7.*

* cited by examiner

*Primary Examiner* — Benny T Lee
*Assistant Examiner* — Hafizur Rahman
(74) *Attorney, Agent, or Firm* — IP Business Solutions, LLC

(57) ABSTRACT

A refractive index n of a dielectric material is larger than a refractive index of the outside in a lateral direction X and/or a vertical direction Y perpendicular to an electromagnetic wave travelling direction Z, the inside of a waveguide-path has slow electromagnetic wave propagation velocity, compared to an area on the outside, the maximum dimension in the lateral direction and/or the vertical direction of the waveguide-path has a dimension which is specified by a formula below. The formula is: $\tan(k_s a/2)=k_f/k_s$, or $\tan(k_s a/2)=-k_s/k_f$. Here, $k_s$: propagation constant of an electromagnetic wave low-speed area, $k_f$: propagation constant of an electromagnetic wave high-speed area, and a: maximum dimension in the X direction and/or the Y direction of the waveguide-path.

5 Claims, 10 Drawing Sheets

DIELECTRIC WAVEGUIDE-PATH DEVICE

CROSS-REFERENCE TO THE RELATED APPLICATION

This application claims foreign priority to Japanese Patent Application No. 2015-230494 filed on Nov. 26, 2015.

BACKGROUND OF THE INVENTION

Field of Invention

The present invention relates to a dielectric waveguide-path device and in particular, to a dielectric waveguide-path device made such that a signal from the outside can be accurately, efficiently, and less-noisily input to and guided through a waveguide path which is configured of a dielectric material having a refractive index n larger than a refractive index outside of the waveguide-path, or such that a signal having a desired frequency can be accurately, efficiently, less-noisily output from an electromagnetic wave which has been guided through a waveguide-path which is configured of a dielectric material having a refractive index n larger than a refractive index outside of the waveguide-path.

Description of Related Art

In the field of satellite communication, information communication, or the like, which uses microwaves and millimeter waves, a waveguide technique is an important factor.

For example, in a waveguide-tube which has an input electrode or an output electrode provided in a waveguide-tube and is made such that an electromagnetic wave is input to and guided through the waveguide-tube, or such that an electric signal is output from an electromagnetic wave which has been propagated through the waveguide-tube, a waveguide-tube has been proposed in which input electrodes or output electrodes are disposed such that two or more electrodes each having a shape extending in a waveguide-tube width direction are arranged in an electromagnetic wave travelling direction and such that a high-frequency current is applied between electrodes adjacent to each other, among two or more input electrodes, or an electric signal is output from between electrodes adjacent to each other, among two or more output electrodes, and the input electrodes or the output electrodes are disposed such that the outer peripheral shape of the electrode array is inherent in the waveguide-tube and is a shape corresponding to a portion or the whole of a shape which is determined by a specific numerical expression (formula 1 in Patent Document 1), whereby a signal from the outside is accurately, efficiently, and less-noisily input to and guided through the waveguide-tube, or a signal having a desired frequency is accurately, efficiently, and less-noisily output from an electromagnetic wave which has been guided through the waveguide-tube (Patent Document 1).

The dielectric waveguide-path for guiding light among electromagnetic wave are known, such as optical fibers and in non-patent literature 1, the conditions that light of a plurality of modes is guided in a planar dielectric waveguide-path in which both sides of a flat core are sandwiched by claddings are shown.

Patent Document 1 Japanese Patent No. 5732247

Non-Patent literature 1 A planar dielectric waveguide (Mendez, University of Louisville Jul. 18, 2010)

SUMMARY OF THE INVENTION

Technical Problem

The waveguide technique of Patent Document 1 exhibits an excellent effect with respect to the wave guide of an electromagnetic wave in a waveguide-tube. However, whether the technique can be applied to the waveguide-path of an electromagnetic wave in a so-called dielectric waveguide-path which is configured of a dielectric material, and in a case where it can be applied thereto, the conditions thereof are obscure.

Also, in Non-Patent literature 1, since it is an optical waveguide-path device, it is necessary to generate an optical signal by an external laser generator and input it to the waveguide, in the case of the GH band electromagnetic wave, it was unclear how to generate the electromagnetic wave and input it to the waveguide-path.

The present invention provides a dielectric waveguide-path device made such that in a dielectric waveguide-path, a signal from the outside is accurately, efficiently, and less-noisily input to and guided through the waveguide-path, or a signal having a desired frequency is accurately, efficiently, and less-noisily output from an electromagnetic wave which has been propagated through the dielectric waveguide-path.

Solution to Problem

Therefore, according to an aspect of the present invention, there is provided a dielectric waveguide-path device in which a waveguide-path is configured of a dielectric material, and when an electromagnetic wave travelling direction of the waveguide-path is set to be a Z direction and directions perpendicular to the Z direction and perpendicular to each other are set to be an X direction and a Y direction, a refractive index n of the dielectric material of the waveguide-path is larger than a refractive index of the outside in the X direction and/or the Y direction, a waveguide-path inner region has slow electromagnetic wave propagation velocity in the Z direction, compared to an area on the outside in the X direction and/or the Y direction, the maximum dimension in the X direction and/or the Y direction of the waveguide-path has a dimension which is specified by formula 1, whereby a lateral vibration mode curve of an electric field inherent in the waveguide-path and an electric field attenuation curve outside of the waveguide-path are continuous on both surfaces of the waveguide-path in the X direction and/or the Y direction, an electromagnetic wave in a lateral vibration mode of an electric field is transmitted in the form of a cosine distribution or a sine distribution in the Z direction of electromagnetic wave while being totally reflected by both surfaces in the X direction and/or the Y direction of the waveguide-path, the waveguide-path has an input electrode structure in which a plurality of electrodes extending in the X direction and/or the Y direction are arranged at regular intervals with respect to the Z direction, on the inside or the surface thereof.

$$\tan(k_s a/2)=k_f/k_s, \text{ or}$$

$$\tan(k_s a/2)=-k_s/k_f \qquad \text{[Formula 1]}$$

Here, the former formula is an expression when an electromagnetic wave is propagated in a cosine (cos) distribution, and the latter formula is an expression when an electromagnetic wave is propagated in a sine (sin) distribution, $k_s$: propagation constant of an electromagnetic wave low-speed area, $k_f$: propagation constant of an electromagnetic wave high-speed area, and a: maximum dimension in the X direction and/or the Y direction of the waveguide-path.

Further, according to another aspect of the present invention, there is provided a dielectric waveguide-path device in which a waveguide-path is configured of a dielectric material, and when an electromagnetic wave travelling direction of the waveguide-path is set to be a Z direction and directions perpendicular to the Z direction and perpendicular to each other are set to be an X direction and a Y direction, a refractive index n of the dielectric material of the waveguide-path is larger than a refractive index of the outside in the X direction and/or the Y direction, a waveguide-path inner region has slow electromagnetic wave propagation velocity in the Z direction, compared to an area on the outside in the X direction and/or the Y direction, the maximum dimension in the X direction and/or the Y direction of the waveguide-path has a dimension which is specified by formula 1, whereby a lateral vibration mode curve of an electric field inherent in the waveguide-path and an electric field attenuation curve outside of the waveguide-path are continuous on both surfaces of the waveguide-path in the X direction and/or the Y direction, an electromagnetic wave in a lateral vibration mode of an electric field is transmitted in the form of a cosine distribution or a sine distribution in the Z direction while being totally reflected by both surfaces in the X direction and/or the Y direction of the waveguide-path, the waveguide-path has an output electrode structure in which a plurality of electrodes extending in the X direction and/or the Y direction are arranged at regular intervals with respect to the Z direction, on the inside or the surface thereof.

$$\tan(k_s a/2)=k_f/k_s, \text{ or}$$

$$\tan(k_s a/2)=-k_s/k_f \qquad \text{[Formula 1]}$$

Here, the former formula is an expression when an electromagnetic wave is propagated in a cosine (cos) distribution, and the latter formula is an expression when an electromagnetic wave is propagated in a sine (sin) distribution, $k_s$: propagation constant of an electromagnetic wave low-speed area, $k_f$: propagation constant of an electromagnetic wave high-speed area, and a: maximum dimension in the X direction and/or the Y direction of the waveguide-path.

The inventor of the present invention has performed extensive studies with regard to transmission of an electromagnetic wave in a dielectric waveguide-path and as a result, has led to the knowledge that a waveguide-path is configured of a dielectric material having a refractive index larger than an refractive index outside of the waveguide-path, whereby the inside of the waveguide-path can be formed into an electromagnetic wave propagation area in the Z direction having a lower speed (hereinafter, referred to as an electromagnetic wave low-speed area) compared to electromagnetic wave propagation velocity in the Z direction on the outside in the width direction X and/or the height direction Y (hereinafter, referred to as an electromagnetic wave high-speed area), a lateral vibration mode of an electric field in which a lateral vibration mode curve of an electric field inherent in the waveguide-path and an electric field attenuation curve outside of the waveguide-path are continuous on both the side surfaces and/or both the upper and lower surfaces of the waveguide-path is specified by the quality of the dielectric material and the maximum dimension in the width direction X and/or the height direction Y of the waveguide-path, and an electromagnetic wave which is determined by the lateral vibration mode of an electric field is propagated in the form of a cosine distribution or a sine distribution with respect to the waveguide-path width direction in the electromagnetic wave travelling direction (the Z direction) by being totally reflected by both the side surfaces and/or both the upper and lower surfaces of the waveguide-path.

That is, the lateral vibration mode of an electric field is established by the condition that the electric field distribution inside of the waveguide-path and the electric field distribution outside of the waveguide-path are continuous at the boundary between the inside and the outside of the dielectric waveguide-path, and the lateral vibration mode of an electric field inherent in the dielectric having a refractive index larger than an refractive index outside of the waveguide-path is determined by a material of the dielectric and the width in the width direction X and/or the height in the up-and-down direction Y of the dielectric. The lateral vibration mode of an electric field is represented by a cosine (cos) curve or a sine (sin) curve, and there exist a large number of orders (mode order n=1 (a cosine curve), 2 (a sine curve), 3, (a cosine curve), 4 (a sine curve) . . . ).

In a case of guiding an electromagnetic wave in the dielectric waveguide-path, if a plurality of input electrodes are disposed side by side at intervals corresponding to a wavelength in the electromagnetic wave travelling direction and a high-frequency current is applied between the electrodes adjacent to each other, an electromagnetic wave can be accurately, efficiently, and less-noisily guided.

Further, a plurality of electric field lateral vibration modes are inherent in the width direction of a dielectric having a large refractive index, and these modes are used by selecting an electrode configuration, and thus it is possible to accurately, efficiently, and less-noisily output an electromagnetic wave having a single frequency or a plurality of adjacent frequencies.

That is, if the width and/or the height of the dielectric waveguide-path is set to a size which is specified by an equation (a mode equation) which is represented by formula 1, an electromagnetic wave travels through the dielectric waveguide-path while being totally reflected at both the boundary surfaces in the waveguide-path width direction X and/or both the boundary surfaces in the waveguide-path height direction Y. At that time, the lateral vibration mode of an electric field occurs in the waveguide-path width direction X and/or the height direction Y.

The lateral vibration mode curve of an electric field inherent in the dielectric waveguide-path is represented by a cosine curve or a sine curve. The condition for the presence of the electric field lateral vibration mode of an electromagnetic wave is that electric field distributions inside and outside of the waveguide-path are continuous at a boundary surface in the width direction and/or the up-and-down direction of the waveguide-path.

Here, a numerical expression in which the lateral vibration mode curve of an electric field and the electric field attenuation curve are continuous at the boundary surface between the inside and the outside of the waveguide-path is as follows;

$$\tan(k_s a/2)=k_f/k_s, \text{ or}$$

$$\tan(k_s a/2)=-k_s/k_f \qquad \text{[Formula 1]}$$

The former formula is an expression when an electromagnetic wave is propagated in a cosine (cos) distribution, and the latter formula is an expression when an electromagnetic wave is propagated in a sine (sin) distribution, $k_s$: propagation constant of an electromagnetic wave low-speed area, $k_f$: propagation constant of an electromagnetic wave high-speed area, and a: maximum dimension in the X direction and/or the Y direction of the waveguide-path.

If the condition of continuity of an electric field is satisfied at the end faces of both the side surfaces and/or both the upper and lower surfaces of the dielectric waveguide-path, the lateral vibration mode of an electric field of an order in accordance with a material of the waveguide-path and the width and/or the up-and-down height of the waveguide-path is established. Reflection is repeated at the end faces in the waveguide-path width direction, and thus a mode of an electromagnetic wave is made and travels in the Z direction. If the lateral vibration mode is not established, an electromagnetic wave cannot travel.

A first feature of the present invention has been made based on such knowledge, and a first task is to provide a dielectric waveguide-path device made so as to be able to accurately, efficiently, and less-noisily guide or output an electromagnetic wave with a simple configuration.

A second feature of the present invention is to provide a dielectric waveguide-path device made so as to be able to convert a propagation frequency into a close frequency without changing a period of an electrode in the electromagnetic wave travelling direction, by selecting the configurations of the input electrode and the output electrode, and be able to input and output a signal having the close frequency.

That is, there is the feature that it is possible to output a signal having a frequency selected from the frequency of an input signal, and therefore, if this is applied, it is possible to configure a filter device capable of passing only a desired frequency therethrough.

Now, there is the relationship shown in FIG. 8 between the width of the dielectric waveguide-path and the maximum mode order. It can be seen from FIG. 8 that if the width of the waveguide-path is set to be less than a width in which a basic electric field lateral vibration mode (n=1) is established, the lateral vibration mode of an electric field is not established and an electromagnetic wave cannot be propagated.

That is, in a case where an electromagnetic wave is propagated in the lateral vibration mode of an electric field, in order to eliminate the influence of the lateral vibration mode in the up-and-down height direction of the waveguide-path, it is preferable to set the width of the waveguide-path be less than an order in which a lateral vibration mode of order 1 of a propagation frequency is established. Further, in order to eliminate leakage of an electromagnetic wave from the upper and lower surfaces, by providing conductor plates at the upper and lower boundary surfaces, it is possible to propagate an electromagnetic wave in the lateral vibration mode of an electric field in a horizontal direction, regardless of the up-and-down height of the waveguide-path.

Further, in the dielectric waveguide-path, an electromagnetic wave is propagated in the travelling direction Z in a period of a wavelength in the travelling direction in the waveguide-path in the form of a cosine (cos) distribution or a sine (sin) distribution in the waveguide-path width direction while changing the polarity thereof for each ½ period of the wavelength in the travelling direction in the waveguide-path. In a case of exciting an electromagnetic wave having a wavelength in the travelling direction in the waveguide-path, which is determined by a material of the dielectric waveguide-path and the waveguide-path width and/or the up-and-down height, an electric field is generate between electrodes which are present at places having an electric field distribution of the same polarity as the wavelength in the travelling direction in the waveguide-path, and is combined with the electric field which is propagated in the lateral vibration mode. An electric field in the direction opposite to that of the previous electric field is generated between electrodes each having a reverse polarity which is the next polarity of the wavelength in the travelling direction in the waveguide-path, and is combined with the electric field which is propagated in the lateral vibration mode. Therefore, an interval P in the electromagnetic wave travelling direction Z of the plurality of input electrodes needs to be a ½ period of the wavelength in the travelling direction in the waveguide-path. It can be understood that the same applies to the output electrode.

That is, in the input electrode or the output electrode, the electrodes are disposed side by side and a high-frequency current is applied such that the electrodes adjacent to each other have polarities opposite to each other, or a high-frequency current is taken out from electromagnetic waves from the electrodes adjacent to each other. By using the lateral vibration mode of an electric field inherent in the waveguide-path width direction X and/or the up-and-down height direction Y, it becomes possible to obtain a waveguide-path device which is more accurate, efficient, and less-noisy.

If the length in the electromagnetic wave travelling direction Z between the electrodes or electrode portions adjacent to each other is less than or equal to ½ of the wavelength in the travelling direction in the waveguide-path, the combination of the electric field which is applied between the electrodes adjacent to each other with the electric field which is propagated in the lateral vibration mode is present, and thus the length between the electrodes may be any length. Further, it is preferable that the plurality of electrodes are provided side by side at intervals of a ½ period of the wavelength in the travelling direction in the waveguide-path, which is determined by a material of the dielectric waveguide-path and the waveguide-path width and/or the up-and-down height.

In the present invention, it is possible to adopt a simple structure in which electrodes having the same shape are simply provided side by side in the electromagnetic wave travelling direction. That is, in the design of the input electrode or the output electrode, it is favorable if a plurality of electrodes are provided in the Z direction such that a polarity changes for each ½ period of the wavelength in the travelling direction in the waveguide-path, which is determined from the quality of a dielectric material of the waveguide-path and the waveguide-path width and/or the up-and-down height, and an electrode shape corresponding to the lateral vibration mode curve with respect to a desired frequency is adopted, simple manufacturing is possible.

In this case, if the number of electrodes is two or more, it is possible to excite an electromagnetic wave. However, in order to more accurately and efficiently guide an electromagnetic wave, it is necessary to increase the number of electrodes. If the number of electrodes is increased, frequency selectivity also increases, and thus it becomes possible to obtain an optimal input/output device.

Further, with respect to the shape of a piece of electrode, it may not be a metal column and it may be a thin plate shape, an elliptical column, a rectangular column, or the like. If the area of an electric field which is applied is taken in large numbers, efficiency is determined by formula 2 from an electric field distribution and an electric field mode distribution. However, a lot of power can be guided to electromagnetic waves.

Figure 1:
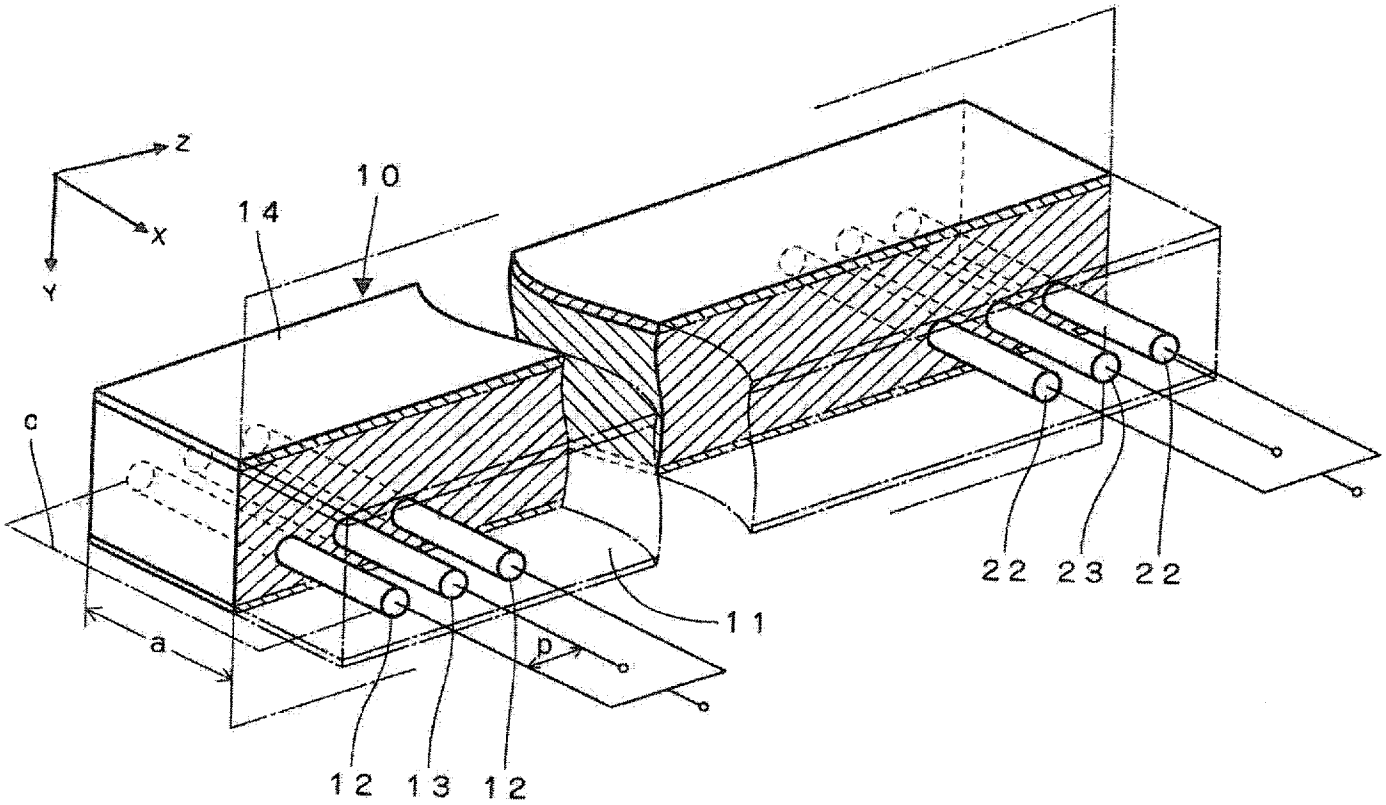
FIG. 1 is a partially cutaway perspective view showing a preferred embodiment of a dielectric waveguide-path device according to the present invention.

For example, as shown in FIG. 1, a dielectric waveguide-path 10 is configured of a dielectric 11 having a refractive index n larger than a refractive index outside of the waveguide-path, and the dimension in a width direction of the dielectric waveguide-path 10 is set to be the dimension satisfying formula 1 and an up-and-down height is set to be less than the dimension a (to a dimension in which a mode is not established). In this case, each of the upper surface and the lower surface of the dielectric 11 can also be covered with a metal body 14 such that electromagnetic waves do not leak from the upper surface and the lower surface of the dielectric 11. Round bar-shaped input electrodes 12 and 13 extending in the width direction X are disposed side by side in the electromagnetic wave travelling direction Z at a middle position C in the height direction Y in the dielectric waveguide-path 10, and a high-frequency current is applied so as to form polarities opposite to each other between the input electrodes 12 and 13 adjacent to each other. The interval P in the electromagnetic wave travelling direction between the input electrodes 12 and 13 adjacent to each other is set to be a ½ period of a wavelength in the waveguide-path, which is determined by a material constant of the dielectric 11 configuring the dielectric waveguide-path 10 and the waveguide-path width. Also with respect to output electrodes 22 and 23, the interval P therebetween in the electromagnetic wave travelling direction is set to be a ½ period of a wavelength in the waveguide-path, which is determined by a material constant of the dielectric 11 configuring the dielectric waveguide-path 10 and the waveguide-path width.

Figure 2:
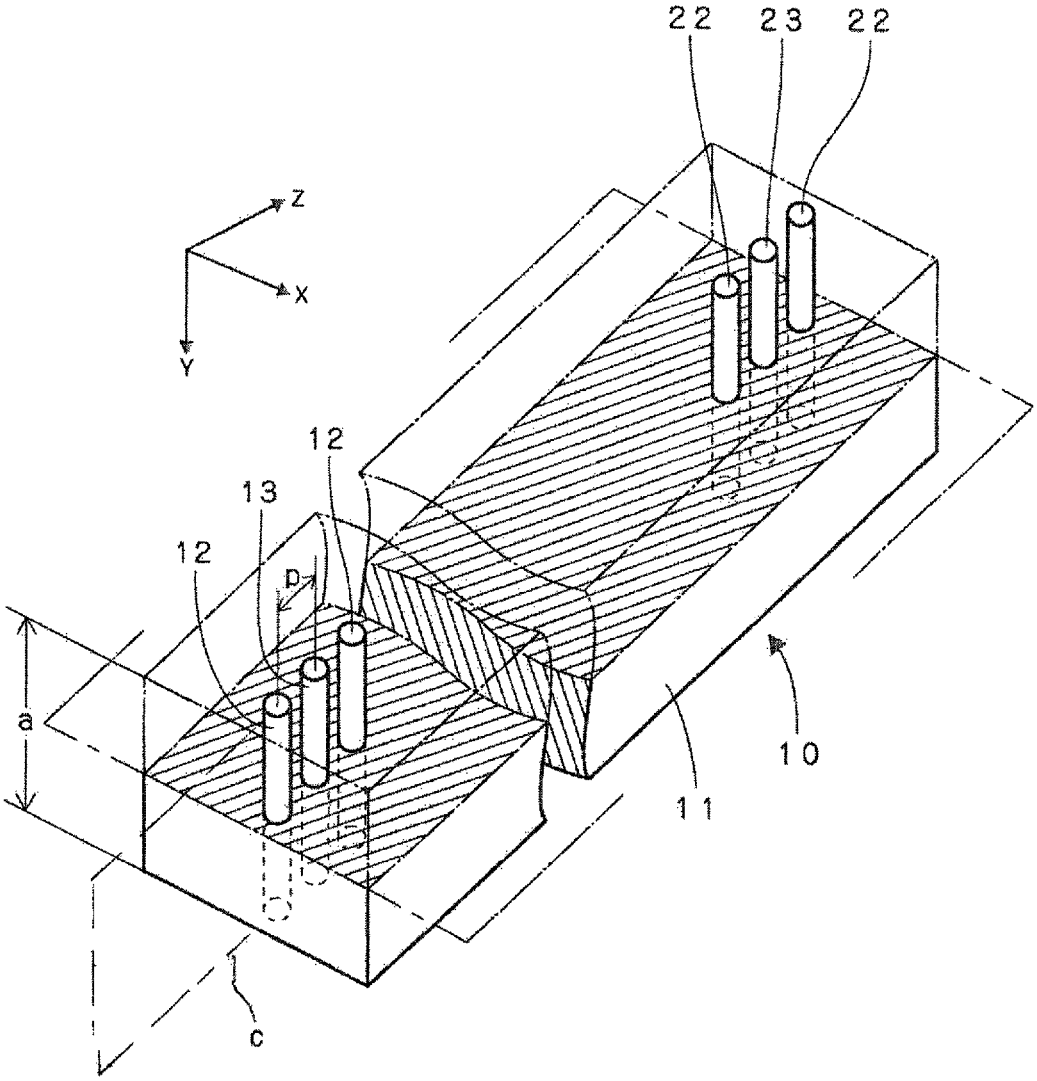
FIG. 2 is a partially cutaway perspective view showing another example of the dielectric waveguide-path device.

Further, as shown in FIG. 2, it is also possible to set the up-and-down height of the dielectric waveguide-path 10 to the dimension a satisfying formula 1 and set the dimension in the width direction to a dimension less than the dimension a (to a dimension in which a mode is not established).

If a high-frequency current is applied between the input electrode 12 on one side and the input electrode 13 on the other side, which are adjacent to each other, it is possible to accurately guide an electromagnetic wave having a frequency which is determined by a wavelength having a length of 2P in the waveguide-path 10.

Even if the input electrodes 12 and 13 are provided at any position in the height direction Y in the dielectric waveguide-path 10, there is the effect. However, if the input electrodes 12 and 13 are provided in the vicinity of the middle in the height direction Y, symmetry is made in a vertical direction, and thus an operation is stable.

In the case of the output electrodes 22 and 23, similar to the case of the input electrodes 12 and 13, round bar-shaped output electrodes 22 and 23 extending in the width direction X are disposed side by side in the electromagnetic wave travelling direction Z at the middle position in the height direction Y in the dielectric waveguide-path 10, and a signal of an electromagnetic wave which has been transmitted can be taken out from between the output electrodes 22 and 23 adjacent to each other.

Figure 3:
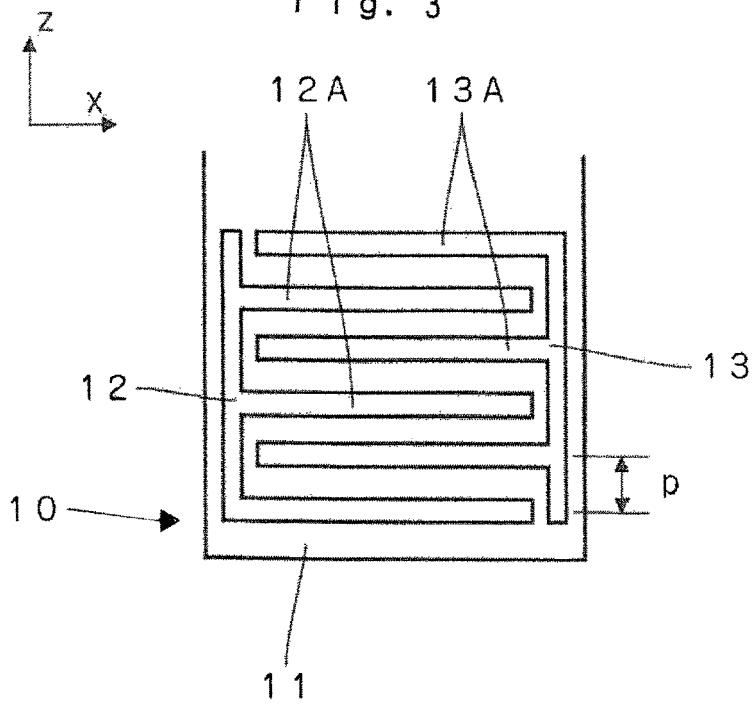
FIG. 3 is a plan view showing an example of the configuration of electrodes array in the dielectric waveguide-path device according to the present invention.

Further, as shown in FIG. 3, a plurality of electrode-shaped portions 12A extending in the width direction X of the waveguide-path 10, of the input electrode 12, and a plurality of electrode-shaped portions 13A extending in the width direction X of the waveguide-path 10, of the input electrode 13, can also be provided side by side in the electromagnetic wave travelling direction Z. In this case, an electric field is generated at a place where the electrode-shaped portion 12A of the input electrode 12 and the electrode-shaped portion 13A of the input electrode 13 face each other. A distribution of the generated electric field and a distribution of an electric field which is propagated in a lateral vibration mode in an electric field inherent in a period of a wavelength in the waveguide-path 10 are combined with each other, thereby guiding an electromagnetic wave. In the case of the output electrodes 22 and 23, a high-frequency current induced by an electromagnetic wave is output.

If the maximum width (and/or the maximum height) of the dielectric waveguide-path 10 is set to a size in which the lateral vibration mode curve of an electric field in the waveguide-path 10 and the electric field attenuation curve outside of the waveguide-path 10 are continuous, an electromagnetic wave travels through the dielectric waveguide-path 10 while being totally reflected at a boundary surface in the direction X of the waveguide-path maximum width (and/or the direction Y of the maximum height). At that time, the lateral vibration mode of an electric field occurs in the width direction X (and/or the up-and-down direction Y) of the waveguide-path.

Figure 9:
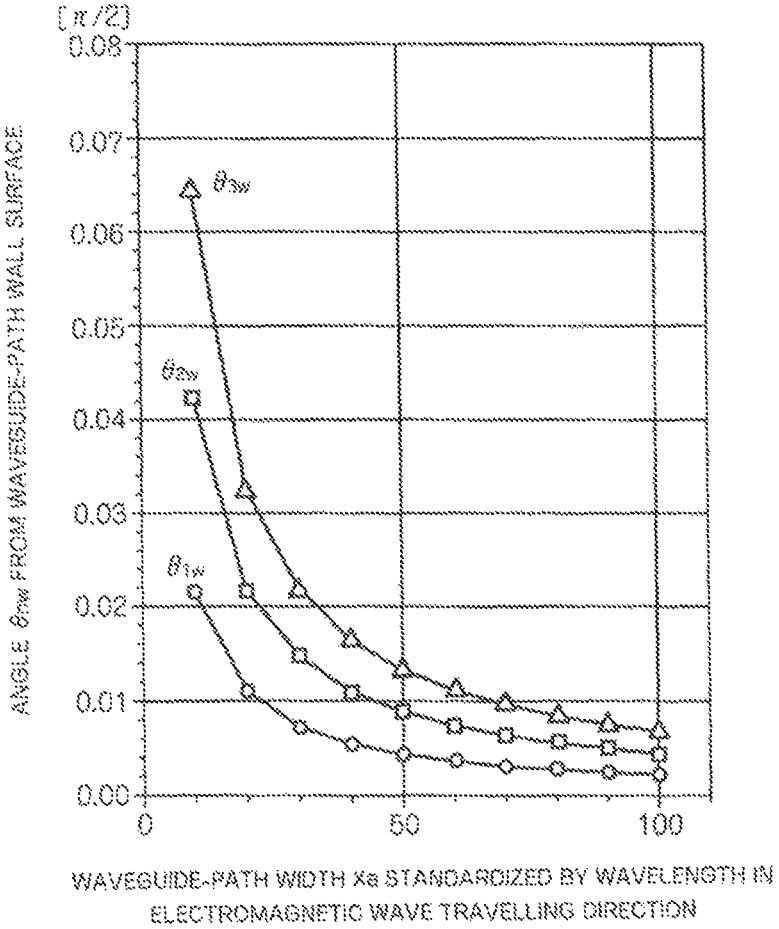
FIG. 9 is a diagram showing a change in the reflection angle of an electromagnetic wave with respect to a change in the width of a dielectric waveguide-path in the present invention.

Here, when reflection angles θnw of electromagnetic waves in mode orders n of 1, 2, and 3 in the waveguide-path with respect to the width of the dielectric waveguide-path were determined, the results shown in FIG. 9 were obtained. Looking at, for example, a reflection angle θ1*w* of a fundamental wave (n=1) (an angle between a waveguide-path end face and an electromagnetic wave incidence direction and an angle in mode order 1) from FIG. 9, if the width of the waveguide-path is changed, the reflection angle θ1*w* of an electromagnetic wave changes.

That is, it can be seen that if the waveguide-path width is set to be a size in which the lateral vibration mode curve of an electric field in the waveguide-path and the electric field attenuation curve outside of the waveguide-path are continuous, an electromagnetic wave travels through the dielectric waveguide-path to satisfy a total reflection condition (from the Snell's law, a total reflection angle is $0.51\cdot\pi/2$) at a boundary surface in the direction of the waveguide-path maximum width.

The lateral vibration mode curve of an electric field inherent in the dielectric waveguide-path is represented by a cosine curve or a sine curve. The condition for the presence of the electric field lateral vibration mode of an electromagnetic wave is that electric field distributions inside and outside of the waveguide-path are continuous at a boundary surface in the width direction or the height direction of the dielectric waveguide-path.

If electric field distributions are continuous inside and outside of the waveguide-path at both the side surfaces or both the upper and lower surfaces of the dielectric waveguide-path, an electric field lateral vibration mode of an order in accordance with a material of the waveguide-path and the waveguide-path width or height is established in the width direction or the height direction.

Further, the inventor of the present invention has studied transmission efficiency between an electric field distribution caused by applying a high-frequency current to a plurality of electrodes installed in order to input an electromagnetic wave into the waveguide-path, and a lateral vibration mode distribution of an electric field of an electromagnetic wave propagating through the waveguide-path, and as a result, has found that conversion efficiency which is transferred from the high-frequency current to the electromagnetic wave in the waveguide-path is determined by formula 2.

[Formula 2]

$$T_n = \frac{\int_{-\frac{a}{2}}^{\frac{a}{2}} f(x)G_n(x)dx}{\sqrt{\int_{-\frac{a}{2}}^{\frac{a}{2}} f^2(x)dx}\sqrt{\int_{-\frac{a}{2}}^{\frac{a}{2}} G_n^2(x)dx}}$$

$T_n$: conversion efficiency from an outer peripheral shape f(x) of electrodes to an electromagnetic wave having an n-th order electric field lateral vibration mode distribution $G_n(x)$, or conversion efficiency from an electromagnetic wave having an n-th order electric field lateral vibration mode distribution $G_n(x)$ to a high-frequency current which is induced in electrodes having the outer peripheral shape f(x), f(x): outer peripheral shape of electrodes, $G_n(x)$: n-th order electric field lateral vibration mode distribution, a: maximum dimension in the X direction and/or the Y direction of the waveguide-path, and x: coordinate in the waveguide-path width direction with a waveguide-path middle position as zero.

That is, the above formula 2 shows the relationship between an electric field distribution which is applied by a plurality of input electrodes and a lateral vibration mode distribution of an electric field inherent in the dielectric waveguide-path, that is, conversion efficiency to an electromagnetic wave having the n-th order electric field lateral vibration mode distribution $G_n(x)$ which is transmitted from the applied electric field to the waveguide-path by the outer peripheral shape f(x) of the input electrodes.

Further, the above formula 2 shows the relationship between the n-th order electric field lateral vibration mode distribution $G_n(x)$ of an electromagnetic wave which has been propagated as an electric field lateral vibration mode inherent in the waveguide-path, and the outer peripheral shape f(x) of the output electrodes, that is, conversion efficiency from an electromagnetic wave having the n-th order electric field lateral vibration mode distribution $G_n(x)$ to a high-frequency current which is induced in the outer peripheral shape f(x) of the output electrode.

That is, the above formula 2 can be understood as an expression showing the conversion efficiency between the outer peripheral shape of the input or output electrodes and the lateral vibration mode distribution of an electric field inherent in the dielectric waveguide-path, in the conversion between a high-frequency current and an electromagnetic wave.

it is found from the formula 2 that when f(x) and $G_n(x)$ are mathematically the same function, that is, when the outer peripheral shape f(x) of the input or output electrodes and the lateral vibration mode distribution $G_n(x)$ of an electric field inherent in the waveguide-path are the same, the conversion efficiency of input to the waveguide-path or output from the waveguide-path is 1 and the conversion efficiency of the lateral vibration mode of the other electric field is 0.

That is, it is shown that if the lateral vibration mode distribution of the n-th order electric field inherent in the waveguide-path, and the outer peripheral shape of electrode array that a plurality of input electrodes or output electrodes form, or the shape that a plurality of electrode-shaped portions form are the same, the conversion efficiency is 1 that is the maximum, and conversion can be performed without loss from a high-frequency current to an electromagnetic wave in the waveguide-path or from an electromagnetic wave in the waveguide-path to a high-frequency current outside of the waveguide-path.

Therefore, in the outer peripheral shape of the input electrode or the output electrode, a plurality of electrodes or a plurality of electrode-shaped portions can be disposed in a shape corresponding to a portion or the whole of a lateral vibration mode distribution of an electric field of an interested order, of the lateral vibration mode distribution of an electric field inherent in the waveguide-path. Examples in which an array of the electrodes 12 and 13 is disposed in an outer peripheral shape corresponding to a portion or the whole of the lateral vibration mode distribution of an electric field inherent in the waveguide-path 10 are shown in FIGS. 4 to 6.

Figure 10:
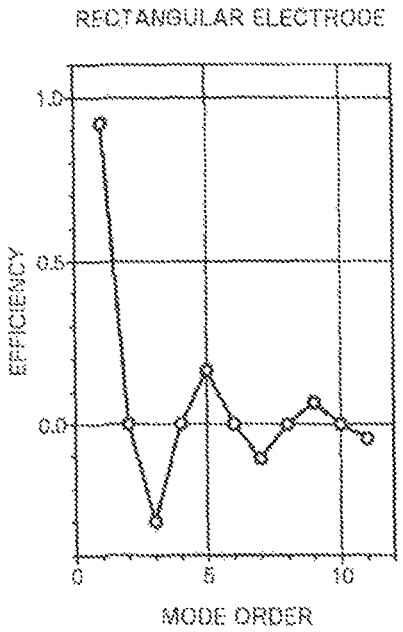
FIG. 10(*a*) is a diagram showing efficiency with respect to a mode order in a rectangular electrode in the present invention, and FIG. 10(*b*) is a diagram showing efficiency with respect to a mode order in a fundamental mode shape electrode.
Figure 10:
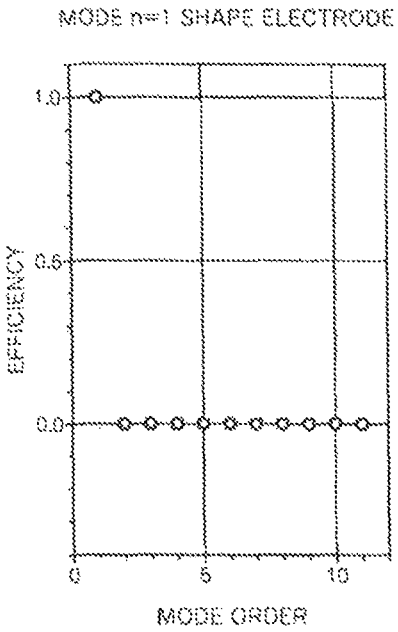

Various harmonic components are present and are included in rectangular electrodes, as shown by the result of formula 2 (FIG. 10A). In a case of input electrodes having an outer peripheral shape corresponding to an electric field distribution curve of a fundamental wave (first order) electric field mode, as shown in FIG. 10B, only a fundamental component having a fundamental wave electric field mode is present, and the conversion efficiency is 1 only at the frequency in a fundamental wave mode and the conversion efficiency in the other frequency component is 0. That is, input electrodes having an outer peripheral shape corresponding to an electric field distribution in the fundamental wave mode have the feature like a kind of filter, and in an electromagnetic wave, only a frequency component having an electric field distribution in accordance with the outer peripheral shape of electrodes is transmitted into the waveguide-path.

Figure 4:
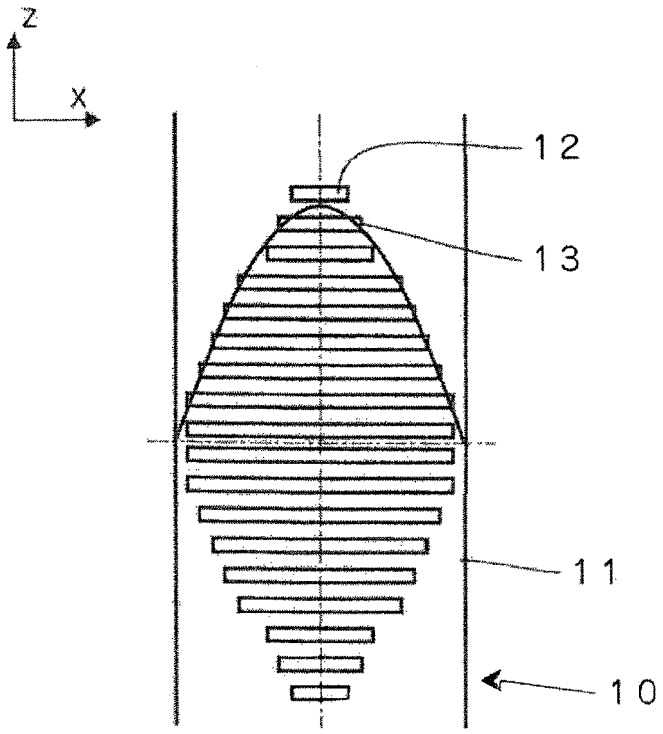
FIG. 4 is a plan view showing an example in which the outer peripheral shape of array of input electrodes in the dielectric waveguide-path device according to the present invention is formed in a shape corresponding to a lateral vibration mode distribution of an electric field.
Figure 5:
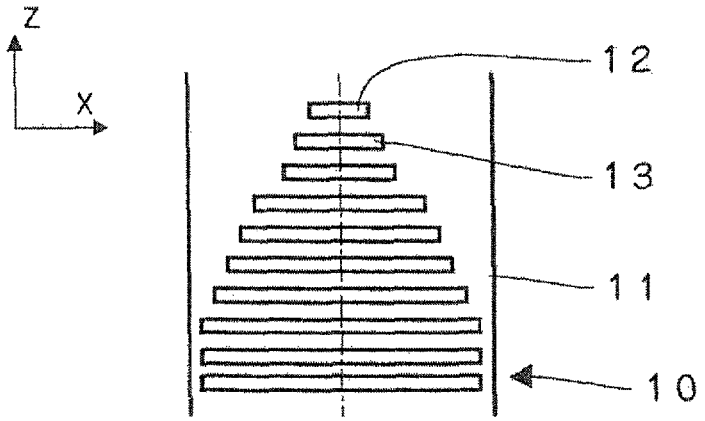
FIGS. 5(*a*) and 5(*b*) are plan views showing other examples in which the outer peripheral shape of the array of the input electrodes is formed in a shape corresponding to the lateral vibration mode distribution of an electric field.
Figure 5:
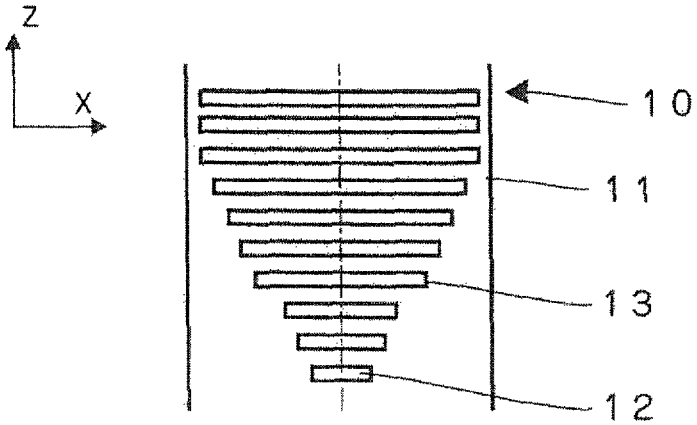
Figure 6:
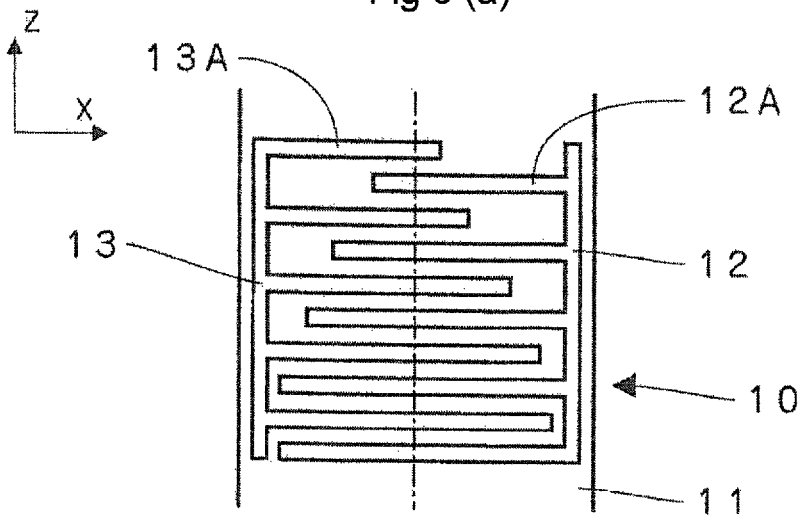
FIGS. 6(*a*) and 6(*b*) are plan views showing still other examples in which the outer peripheral shape of the array of the input electrodes is formed in a shape corresponding to the lateral vibration mode distribution of an electric field.
Figure 6:
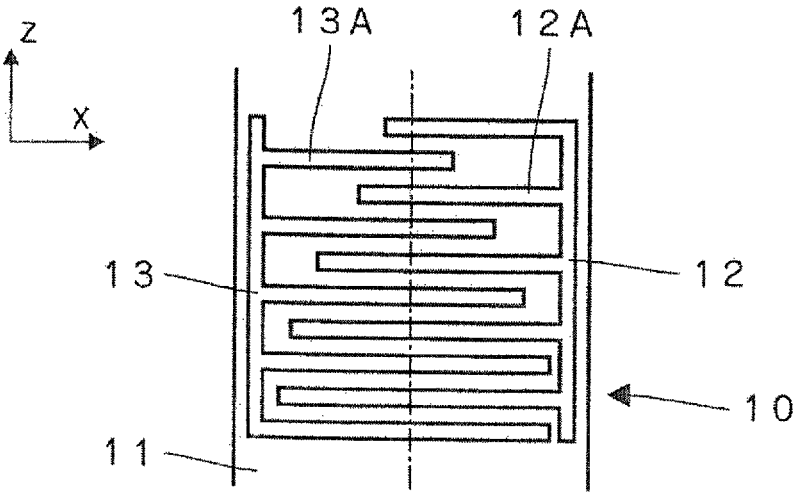

In this way, the outer peripheral shape of electrodes array of the plurality of input electrodes 12 and 13 disposed side by side in the electromagnetic wave travelling direction, as shown in FIGS. 4 and 5, for example, and an outer peripheral shape composed of portions in which the electrode-shaped portions 12A and 13A of the input electrodes 12 and 13 face each other, as shown in FIG. 6, are set to be a shape corresponding to the lateral vibration mode distribution of an electric field inherent in the waveguide-path 10, whereby only a frequency component having an electric field distribution component matching an outer peripheral shape composed of the facing portions of the electrode array of the input electrodes 12 and 13 is transmitted into the dielectric waveguide-path.

That is, by generating an electric field between a plurality of electrodes provided in the dielectric waveguide-path in accordance with an electric field distribution having strength according to the electric field lateral vibration mode distribution inherent in the dielectric waveguide-path, it is possible to selectively guide a desired electromagnetic wave with higher bonding to an electromagnetic wave which propagates a high-frequency current to form a lateral mode distribution in the dielectric waveguide-path, and removal of noise or the like also becomes possible.

In this way, if a high-frequency current is applied to an array of a plurality of input electrodes having an outer peripheral shape which is specified by the electric field lateral vibration mode distribution of an interested order, an electromagnetic wave having the electric field lateral vibration mode distribution corresponding to the outer peripheral shape of the electrodes array is transmitted through the dielectric waveguide-path, and an electromagnetic wave in the other lateral vibration mode or noise is not transmitted through the waveguide-path, and it is possible to transmit an electromagnetic wave in a specific lateral vibration mode having less noise and good efficient into the dielectric waveguide-path.

Further, with respect to the case of the output electrode, if an electromagnetic wave propagates through the waveguide-path, only the electric field lateral vibration mode of the frequency component according to the outer peripheral shape is induced in the array of the output electrodes, and the lateral vibration mode of the other frequency component or noise is not induced, and it is possible to output a high-frequency current of only an electromagnetic wave in a specific lateral vibration mode having less noise and good efficient.

It is favorable if a portion or the whole of the outer peripheral shape of the electrodes array is set to be a shape which is specified by the electric field lateral vibration mode distribution of an interested order, and the outer peripheral shape of the electrodes can be formed in, for example, a shape corresponding to a portion or the whole of a cosine curve or a sine curve greater than or equal to a half period.

As the simplest electrode shape, it is possible to set the outer peripheral shape of the electrode to be a shape corresponding to a portion or the whole of the electric field lateral vibration mode curve inherent in the waveguide-path, for example, a shape corresponding to a portion or the whole of the electric field lateral vibration mode curve with respect to the fundamental wave.

Further, as shown in FIGS. 5A and 5B, the input electrodes 12 and 13 corresponding to the lateral vibration mode distribution of an electric field may correspond to either the upper half or the lower half of the lateral vibration mode curve of an electric field, and therefore, the electrodes array of the input electrodes 12 and 13 may be either the upper half or the lower half of the lateral vibration mode curve of an electric field.

With regard to the width direction of the dielectric waveguide-path, an electric field density distribution which is the sum of the electric field strengths in the electromagnetic wave travelling direction which are applied by the electrodes can correspond to the lateral vibration mode distribution of an electric field.

Even if the electrodes are provided at any position in the height direction in the dielectric waveguide-path, there is the effect. However, if the electrodes are provided in the vicinity of the middle in the height direction, symmetry is made in a vertical direction, and thus it is stable. Therefore, it is better to install the electrodes in the vicinity of the middle in the height direction of the dielectric waveguide-path. Further, it is also possible to install the electrodes on the surface.

As the dielectric material, it is possible to adopt optical glass, a magnetic material such as potassium tantalum niobium oxide crystal (KTN), or yttrium iron garnet crystal (YIG), or a known dielectric material such as zinc oxide, plastic, water, or silicon.

Figure 7:
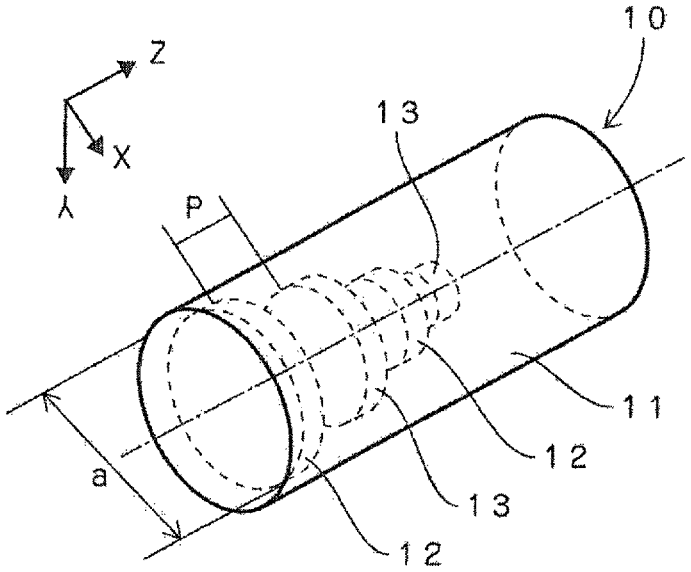
FIG. 7 is a perspective view showing another embodiment of the dielectric waveguide-path device according to the present invention.
Figure 8:
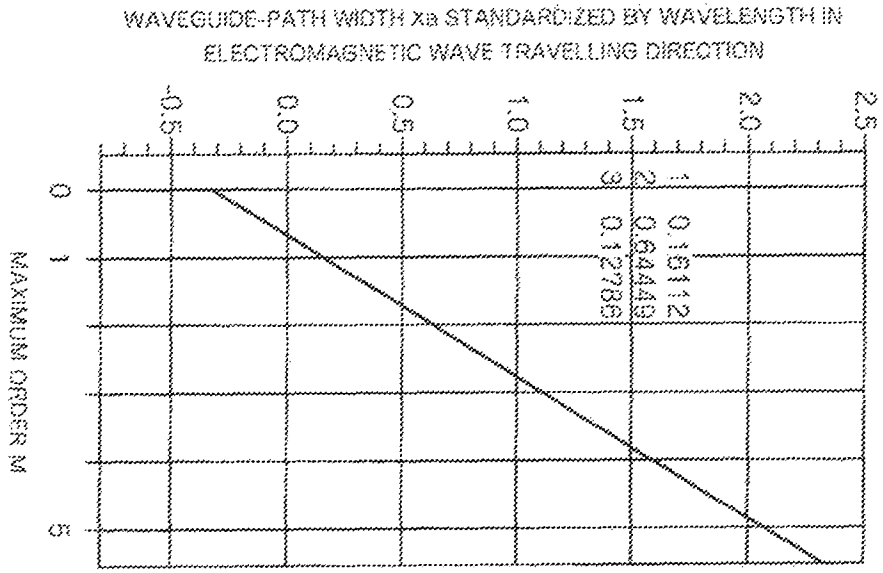
FIG. 8 is a diagram showing the relationship of the maximum mode order of a lateral vibration mode to an electrode width in the present invention.

Further, the cross-sectional shape of the dielectric configuring the waveguide-path can be set to a rectangular shape or a circular shape (including an elliptical shape). For example, in a case where the cross-sectional shape of the dielectric waveguide-path 10 is set to a circular shape in a cross section, as shown in FIG. 7, it is possible to adopt the disk-shaped electrodes 12 and 13. In this case, the middle portion of the waveguide can also be bent according to the laying conditions.

DETAILED DESCRIPTION OF THE PREFERRED EMBODIMENTS

For example, as shown in FIG. 1, a dielectric waveguide-path 10 is configured of a dielectric 11 having a refractive index n larger than a refractive index outside of the waveguide-path, and the dimension in a width direction of the dielectric waveguide-path 10 is set to be the dimension satisfying formula 1 and an up-and-down height is set to be less than the dimension a (to a dimension in which a mode is not established). In this case, each of the upper surface and the lower surface of the dielectric 11 can also be covered with a metal body 14 such that electromagnetic waves do not leak from the upper surface and the lower surface of the dielectric 11. Round bar-shaped input electrodes 12 and 13 extending in the width direction X are disposed side by side in the electromagnetic wave travelling direction Z at a middle position C in the height direction Y in the dielectric waveguide-path 10, and a high-frequency current is applied so as to form polarities opposite to each other between the input electrodes 12 and 13 adjacent to each other. The interval P in the electromagnetic wave travelling direction between the input electrodes 12 and 13 adjacent to each other is set to be a ½ period of a wavelength in the waveguide-path, which is determined by a material constant of the dielectric 11 configuring the dielectric waveguide-path 10 and the waveguide-path width. Also with respect to output electrodes 22 and 23, the interval P therebetween in the electromagnetic wave travelling direction is set to be a ½ period of a wavelength in the waveguide-path, which is determined by a material constant of the dielectric 11 configuring the dielectric waveguide-path 10 and the waveguide-path width.

Further, as shown in FIG. 2, it is also possible to set the up-and-down height of the dielectric waveguide-path 10 to the dimension a satisfying formula 1 and set the dimension in the width direction to a dimension less than the dimension a (to a dimension in which a mode is not established).

If a high-frequency current is applied between the input electrode 12 on one side and the input electrode 13 on the other side, which are adjacent to each other, it is possible to accurately guide an electromagnetic wave having a frequency which is determined by a wavelength having a length of 2P in the waveguide-path 10.

Even if the input electrodes 12 and 13 are provided at any position in the height direction Y in the dielectric waveguide-path 10, there is the effect. However, if the input electrodes 12 and 13 are provided in the vicinity of the middle in the height direction Y, symmetry is made in a vertical direction, and thus an operation is stable.

In the case of the output electrodes 22 and 23, similar to the case of the input electrodes 12 and 13, round bar-shaped output electrodes 22 and 23 extending in the width direction X are disposed side by side in the electromagnetic wave travelling direction Z at the middle position in the height direction Y in the dielectric waveguide-path 10, and a signal of an electromagnetic wave which has been transmitted can be taken out from between the output electrodes 22 and 23 adjacent to each other.

Further, as shown in FIG. 3, a plurality of electrode-shaped portions 12A extending in the width direction X of the waveguide-path 10, of the input electrode 12, and a plurality of electrode-shaped portions 13A extending in the width direction X of the waveguide-path 10, of the input electrode 13, can also be provided side by side in the electromagnetic wave travelling direction Z. In this case, an electric field is generated at a place where the electrode-shaped portion 12A of the input electrode 12 and the electrode-shaped portion 13A of the input electrode 13 face each other. A distribution of the generated electric field and a distribution of an electric field which is propagated in a lateral vibration mode in an electric field inherent in a period of a wavelength in the waveguide-path 10 are combined with each other, thereby guiding an electromagnetic wave. In the case of the output electrodes 22 and 23, a high-frequency current induced by an electromagnetic wave is output.

If the maximum width (and/or the maximum height) of the dielectric waveguide-path 10 is set to a size in which the lateral vibration mode curve of an electric field in the waveguide-path 10 and the electric field attenuation curve outside of the waveguide-path 10 are continuous, an electromagnetic wave travels through the dielectric waveguide-path 10 while being totally reflected at a boundary surface in the direction X of the waveguide-path maximum width (and/or the direction Y of the maximum height). At that time, the lateral vibration mode of an electric field occurs in the width direction X (and/or the up-and-down direction Y) of the waveguide-path.

Here, when reflection angles θnw of electromagnetic waves in mode orders n of 1, 2, and 3 in the waveguide-path with respect to the width of the dielectric waveguide-path were determined, the results shown in FIG. 9 were obtained. Looking at, for example, a reflection angle θ1*w* of a fundamental wave (n=1) (an angle between a waveguide-path end face and an electromagnetic wave incidence direction and an angle in mode order 1) from FIG. 9, if the width of the waveguide-path is changed, the reflection angle θ1*w* of an electromagnetic wave changes.

That is, it can be seen that if the waveguide-path width is set to be a size in which the lateral vibration mode curve of an electric field in the waveguide-path and the electric field attenuation curve outside of the waveguide-path are continuous, an electromagnetic wave travels through the dielectric waveguide-path to satisfy a total reflection condition (from the Snell's law, a total reflection angle is 0.51·π/2) at a boundary surface in the direction of the waveguide-path maximum width.

The lateral vibration mode curve of an electric field inherent in the dielectric waveguide-path is represented by a cosine curve or a sine curve. The condition for the presence of the electric field lateral vibration mode of an electromagnetic wave is that electric field distributions inside and outside of the waveguide-path are continuous at a boundary surface in the width direction or the height direction of the dielectric waveguide-path.

If electric field distributions are continuous inside and outside of the waveguide-path at both the side surfaces or both the upper and lower surfaces of the dielectric waveguide-path, an electric field lateral vibration mode of an order in accordance with a material of the waveguide-path and the waveguide-path width or height is established in the width direction or the height direction.

Further, the inventor of the present invention has studied transmission efficiency between an electric field distribution caused by applying a high-frequency current to a plurality of electrodes installed in order to input an electromagnetic wave into the waveguide-path, and a lateral vibration mode distribution of an electric field of an electromagnetic wave propagating through the waveguide-path, and as a result, has found that conversion efficiency which is transferred from the high-frequency current to the electromagnetic wave in the waveguide-path is determined by formula 2.

[Formula 2]

$$T_n = \frac{\int_{-\frac{a}{2}}^{\frac{a}{2}} f(x)G_n(x)dx}{\sqrt{\int_{-\frac{a}{2}}^{\frac{a}{2}} f^2(x)dx}\sqrt{\int_{-\frac{a}{2}}^{\frac{a}{2}} G_n^2(x)dx}}$$

$T_n$: conversion efficiency from an outer peripheral shape f(x) of electrodes to an electromagnetic wave having an n-th order electric field lateral vibration mode distribution $G_n(x)$, or conversion efficiency from an electromagnetic wave having an n-th order electric field lateral vibration mode distribution $G_n(x)$ to a high-frequency current which is induced in electrodes having the outer peripheral shape f(x), f(x): outer peripheral shape of electrodes, $G_n(x)$: n-th order electric field lateral vibration mode distribution, a: maximum dimension in the X direction and/or the Y direction of the waveguide-path, and x: coordinate in the waveguide-path width direction with a waveguide-path middle position as zero.

That is, the above formula 2 shows the relationship between an electric field distribution which is applied by a plurality of input electrodes and a lateral vibration mode distribution of an electric field inherent in the dielectric waveguide-path, that is, conversion efficiency to an electromagnetic wave having the n-th order electric field lateral vibration mode distribution $G_n(x)$ which is transmitted from the applied electric field to the waveguide-path by the outer peripheral shape f(x) of the input electrodes.

Further, the above formula 2 shows the relationship between the n-th order electric field lateral vibration mode distribution $G_n(x)$ of an electromagnetic wave which has been propagated as an electric field lateral vibration mode inherent in the waveguide-path, and the outer peripheral shape f(x) of the output electrodes, that is, conversion efficiency from an electromagnetic wave having the n-th order electric field lateral vibration mode distribution $G_n(x)$ to a high-frequency current which is induced in the outer peripheral shape f(x) of the output electrode.

That is, the above formula 2 can be understood as an expression showing the conversion efficiency between the outer peripheral shape of the input or output electrodes and the lateral vibration mode distribution of an electric field inherent in the dielectric waveguide-path, in the conversion between a high-frequency current and an electromagnetic wave.

it is found from the formula 2 that when f(x) and $G_n(x)$ are mathematically the same function, that is, when the outer peripheral shape f(x) of the input or output electrodes and the lateral vibration mode distribution $G_n(x)$ of an electric field inherent in the waveguide-path are the same, the conversion efficiency of input to the waveguide-path or output from the waveguide-path is 1 and the conversion efficiency of the lateral vibration mode of the other electric field is 0.

That is, it is shown that if the lateral vibration mode distribution of the n-th order electric field inherent in the waveguide-path, and the outer peripheral shape of electrode array that a plurality of input electrodes or output electrodes form, or the shape that a plurality of electrode-shaped portions form are the same, the conversion efficiency is 1 that is the maximum, and conversion can be performed without loss from a high-frequency current to an electromagnetic wave in the waveguide-path or from an electromagnetic wave in the waveguide-path to a high-frequency current outside of the waveguide-path.

Therefore, in the outer peripheral shape of the input electrode or the output electrode, a plurality of electrodes or a plurality of electrode-shaped portions can be disposed in a shape corresponding to a portion or the whole of a lateral vibration mode distribution of an electric field of an interested order, of the lateral vibration mode distribution of an electric field inherent in the waveguide-path. Examples in which an array of the electrodes 12 and 13 is disposed in an outer peripheral shape corresponding to a portion or the whole of the lateral vibration mode distribution of an electric field inherent in the waveguide-path 10 are shown in FIGS. 4 to 6.

Various harmonic components are present and are included in rectangular electrodes, as shown by the result of formula 2 (FIG. 10A). In a case of input electrodes having an outer peripheral shape corresponding to an electric field distribution curve of a fundamental wave (first order) electric field mode, as shown in FIG. 10B, only a fundamental component having a fundamental wave electric field mode is present, and the conversion efficiency is 1 only at the frequency in a fundamental wave mode and the conversion efficiency in the other frequency component is 0. That is, input electrodes having an outer peripheral shape corresponding to an electric field distribution in the fundamental wave mode have the feature like a kind of filter, and in an electromagnetic wave, only a frequency component having an electric field distribution in accordance with the outer peripheral shape of electrodes is transmitted into the waveguide-path.

In this way, the outer peripheral shape of electrodes array of the plurality of input electrodes 12 and 13 disposed side by side in the electromagnetic wave travelling direction, as shown in FIGS. 4 and 5, for example, and an outer peripheral shape composed of portions in which the electrode-shaped portions 12A and 13A of the input electrodes 12 and 13 face each other, as shown in FIG. 6, are set to be a shape corresponding to the lateral vibration mode distribution of an electric field inherent in the waveguide-path 10, whereby only a frequency component having an electric field distribution component matching an outer peripheral shape composed of the facing portions of the electrode array of the input electrodes 12 and 13 is transmitted into the dielectric waveguide-path.

That is, by generating an electric field between a plurality of electrodes provided in the dielectric waveguide-path in accordance with an electric field distribution having strength according to the electric field lateral vibration mode distribution inherent in the dielectric waveguide-path, it is possible to selectively guide a desired electromagnetic wave with higher bonding to an electromagnetic wave which propagates a high-frequency current to form a lateral mode distribution in the dielectric waveguide-path, and removal of noise or the like also becomes possible.

In this way, if a high-frequency current is applied to an array of a plurality of input electrodes having an outer peripheral shape which is specified by the electric field lateral vibration mode distribution of an interested order, an electromagnetic wave having the electric field lateral vibration mode distribution corresponding to the outer peripheral shape of the electrodes array is transmitted through the dielectric waveguide-path, and an electromagnetic wave in the other lateral vibration mode or noise is not transmitted through the waveguide-path, and it is possible to transmit an electromagnetic wave in a specific lateral vibration mode having less noise and good efficient into the dielectric waveguide-path.

Further, with respect to the case of the output electrode, if an electromagnetic wave propagates through the waveguide-path, only the electric field lateral vibration mode of the frequency component according to the outer peripheral shape is induced in the array of the output electrodes, and the lateral vibration mode of the other frequency component or noise is not induced, and it is possible to output a high-frequency current of only an electromagnetic wave in a specific lateral vibration mode having less noise and good efficient.

It is favorable if a portion or the whole of the outer peripheral shape of the electrodes array is set to be a shape which is specified by the electric field lateral vibration mode distribution of an interested order, and the outer peripheral shape of the electrodes can be formed in, for example, a shape corresponding to a portion or the whole of a cosine curve or a sine curve greater than or equal to a half period.

As the simplest electrode shape, it is possible to set the outer peripheral shape of the electrode to be a shape corresponding to a portion or the whole of the electric field lateral vibration mode curve inherent in the waveguide-path, for example, a shape corresponding to a portion or the whole of the electric field lateral vibration mode curve with respect to the fundamental wave.

Further, as shown in FIGS. 5A and 5B, the input electrodes 12 and 13 corresponding to the lateral vibration mode distribution of an electric field may correspond to either the upper half or the lower half of the lateral vibration mode curve of an electric field, and therefore, the electrodes array of the input electrodes 12 and 13 may be either the upper half or the lower half of the lateral vibration mode curve of an electric field.

With regard to the width direction of the dielectric waveguide-path, an electric field density distribution which is the sum of the electric field strengths in the electromagnetic wave travelling direction which are applied by the electrodes can correspond to the lateral vibration mode distribution of an electric field.

Even if the electrodes are provided at any position in the height direction in the dielectric waveguide-path, there is the effect. However, if the electrodes are provided in the vicinity of the middle in the height direction, symmetry is made in a vertical direction, and thus it is stable. Therefore, it is better to install the electrodes in the vicinity of the middle in the height direction of the dielectric waveguide-path. Further, it is also possible to install the electrodes on the surface.

As the dielectric material, it is possible to adopt optical glass, a magnetic material such as potassium tantalum niobium oxide crystal (KTN), or yttrium iron garnet crystal (YIG), or a known dielectric material such as zinc oxide, plastic, water, or silicon.

Further, the cross-sectional shape of the dielectric configuring the waveguide-path can be set to a rectangular shape or a circular shape (including an elliptical shape). For example, in a case where the cross-sectional shape of the dielectric waveguide-path 10 is set to a circular shape in a cross section, as shown in FIG. 7, it is possible to adopt the disk-shaped electrodes 12 and 13. In this case, the middle portion of the waveguide can also be bent according to the laying conditions.

Example 1

Wave-guiding by Use of Fundamental Mode

In a case of guiding waves by using a frequency in a fundamental mode, the size of a dielectric (optical glass) of a waveguide-path was set so as to have a width a of 104.480 mm and a thickness (in the Y direction) of 3 mm, copper was used as an electrode material, the cross-sectional shape of an electrode was set to be a circular shape, the overall shape of the electrode was set to be a columnar shape, the dimensions of the electrode were set so as to have a diameter of 2 mm and the maximum width of 104.480 mm, an electrode interval P in a waveguide direction was set to 10.448 mm, and the total length of the electrode was set to 106.480 mm.

Example 2

The size of the dielectric of the waveguide-path was set to be a columnar shape having a diameter (in the direction of the width a) of 104.480 mm, copper was used as the electrode material, the cross-sectional shape of the electrode was set to be a disk shape, the dimensions of the electrode were set so as to have the maximum outer diameter of 104.480 mm, and the electrode interval P was set to 10.448 mm.

Example 3

Yttrium iron garnet crystal (refractive index $n_1$=2.2000) was used as a dielectric material of the waveguide-path, and each of both outer sides in the width direction was set to be an air layer (refractive index $n_2$=1.0000). The width of the waveguide-path was set to be 68.248 mm, and the interval P (=λ/2) between the electrodes was set to be 6.825 mm.

Further, when a fundamental wave $f_1$ was set to be 10 GHz and $c_0$ was set to be 3.00000E+08 m/s, propagation velocity $v_1$ (=$c_0/n_1$) in the waveguide-path was 1.36364+08 m/s, propagation velocity $v_2$ (=$c_0/n_2$) outside of the waveguide-path was 3.00E+08 m/s, and $\alpha_s$(=$n_2/n_1$) was 0.45455.

An electromagnetic wave having a wavelength $\lambda_1$ (=$v_1/f_1$) of 13.64956 mm could be propagated.

Example 4

Yttrium iron garnet crystal (refractive index $n_1$=2.2000) was used as the dielectric material of the waveguide-path, and each of both outer sides in the width direction was set to be optical glass (refractive index $n_2$=1.43875). The width of the waveguide-path was set to be 68.313 mm, and the interval P (=λ/2) between the electrodes was set to be 6.831 mm.

Further, when the fundamental wave $f_1$ was set to be 10 GHz and $c_0$ was set to be 3.00E+08 m/s, the propagation velocity $v_1$ (=$c_0/n_1$) in the waveguide-path was 1.36364E+08 m/s, the propagation velocity $v_2$ (=$c_0/n_2$) outside of the waveguide-path was 2.08514E+08 m/s, and $\alpha_s$(=$n_2/n_1$) was 0.65398.

An electromagnetic wave having a wavelength $\lambda_1$ (=$v_1/f_1$) of 13.663 mm could be propagated.

Example 5

Yttrium iron garnet crystal (refractive index $n_1$=2.2000) was used as the dielectric material of the waveguide-path, and each of both outer sides in the width direction was set to be silicon (refractive index $n_2$=1.870829). The width of the waveguide-path was set to be 68.384 mm, and the interval P (=λ/2) between the electrodes was set to be 6.838 mm.

Further, when the fundamental wave $f_1$ was set to be 10 GHz and $c_0$ was set to be 3.00E+08 m/s, the propagation velocity $v_1$ (=$c_0/n_1$) in the waveguide-path was 1.36364E+08 m/s, the propagation velocity $v_2$ (=$c_0/n_2$) outside of the waveguide-path was 1.60357E+08 m/s, and $\alpha_s$(=$n_2/n_1$) was set to be 0.85038.

An electromagnetic wave having a wavelength $\lambda_1$ (=$v_1/f_1$) of 13.677 mm could be propagated.

Example 6

Zinc oxide (refractive index $n_1$=2.0000) was used as the dielectric material of the waveguide-path, and each of both outer sides in the width direction was set to be silicon (refractive index $n_2$=1.87083). The width of the waveguide-path was set to be 75.238 mm, and the interval P (=λ/2) between the electrodes was set to be 7.524 mm.

Further, when the fundamental wave $f_1$ was set to be 10 GHz and $c_0$ was set to be 3.00E+08 m/s, the propagation velocity $v_1$ (=$c_0/n_1$) in the waveguide-path was 1.5E+08 m/s, the propagation velocity $v_2$ (=$c_0/n_2$) outside of the waveguide-path was 1.60357E+08 m/s, and $\alpha_s$(=$n_2/n_1$) was 0.93541.

An electromagnetic wave having a wavelength $\lambda_1$ (=$v_1/f_1$) of 15.048 mm could be propagated.

Example 7

Plastic (refractive index $n_1$=1.7600) was used as the dielectric material of the waveguide-path, and each of both outer sides in the width direction was set to be water (refractive index $n_2$=1.333000). The width a of the waveguide-path was set to be 85.439 mm, and the interval P (=λ/2) between the electrodes was set to be 8.544 mm.

Further, when the fundamental wave $f_1$ was set to be 10 GHz and $c_0$ was set to be 3.00E+08 m/s, the propagation velocity $v_1$ (=$c_0/n_1$) in the waveguide was 1.705E+08 m/s, the propagation velocity $v_2$ (=$c_0/n_2$) outside of the waveguide-path was 2.251E+08 m/s, and $\alpha_s$(=$n_2/n_1$) was 0.75739.

An electromagnetic wave having a wavelength $\lambda_1$ (=$v_1/f_1$) of 17.088 mm could be propagated.

Example 8

Water (refractive index $n_1$=1.33300) was used as the dielectric material of the waveguide-path, and each of both outer sides in the width direction was set to be air (refractive index $n_2$=1.00000). The width of the waveguide-path was set to be 112.803 mm, and the interval P (=λ/2) between the electrodes was set to be 11.28 mm.

Further, when the fundamental wave $f_1$ was set to be 10 GHz and $c_0$ was set to be 3.00E+08 m/s, the propagation velocity $v_1$ (=$c_0/n_1$) in the waveguide was 2.251E+08 m/s, the propagation velocity $v_2$ (=$c_0/n_2$) outside of the waveguide-path was 3.00E+08 m/s, and $\alpha_s$(=$n_2/n_1$) was 0.75019.

An electromagnetic wave having a wavelength $\lambda_1$ (=$v_1/f_1$) of 22.561 mm could be propagated.

Example 9

Optical glass (refractive index $n_1$=1.43875) was used as the dielectric material of the waveguide-path, and each of both outer sides in the width direction was set to be air (refractive index $n_2$=1.00000). The width of the waveguide-path was set to be 104.480 mm, and the interval P (=λ/2) between the electrodes was set to be 10.448 mm.

Further, when the fundamental wave $f_1$ was set to be 10 GHz and $c_0$ was set to be 3.00E+08 m/s, the propagation velocity $v_1$ (=$c_0/n_1$) in the waveguide-path was 2.08514E+08 m/s, the propagation velocity $v_2$ (=$c_0/n_2$) outside of the waveguide-path was 3.00000E+08 m/s, and $\alpha_s$(=$n_2/n_1$) was 0.69505.

An electromagnetic wave having a wavelength $\lambda_1$ (=$v_1/f_1$) of 20.896 mm could be propagated.

Example 11

Silicon (refractive index $n_1$=1.83030) was used as the dielectric material of the waveguide-path, and each of both outer sides in the width direction was set to be air (refractive index $n_2$=1.00000). The width of the waveguide-path was set to be 82.066 mm, and the interval P (=λ/2) between the electrodes was set to be 8.207 mm.

Further, when the fundamental wave $f_1$ was set to be 10 GHz and $c_0$ was set to be 3.00E+08 m/s, the propagation velocity $v_1$ (=$c_0/n_1$) in the waveguide-path was 1.63908E+08 m/s, the propagation velocity $v_2$ (=$c_0/n_2$) outside of the waveguide-path was 3.00000E+08 m/s, and $\alpha_s$(=$n_2/n_1$) was 0.54636.

An electromagnetic wave having a wavelength $\lambda_1$ (=$v_1/f_1$) of 16.413 mm could be propagated.

Example 12

Figure 11:
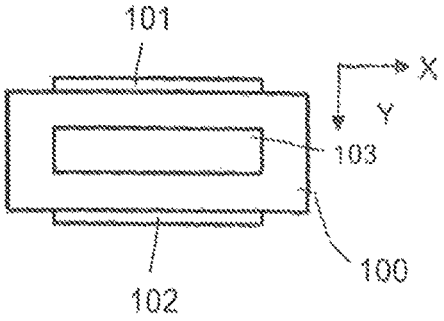
FIGS. 11(*a*) and 11(*b*) are diagrams showing a structure example for another example.
Figure 11:
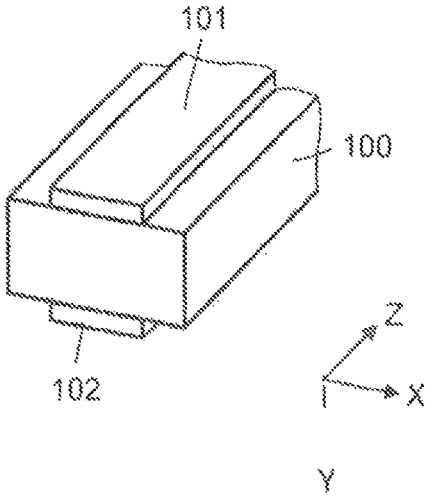
Figure 12:
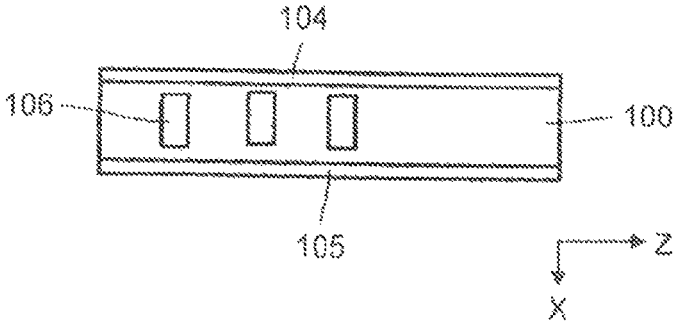
FIGS. 12(*a*) and 12(*b*) are diagrams showing another structure example for explaining another example.
Figure 12:
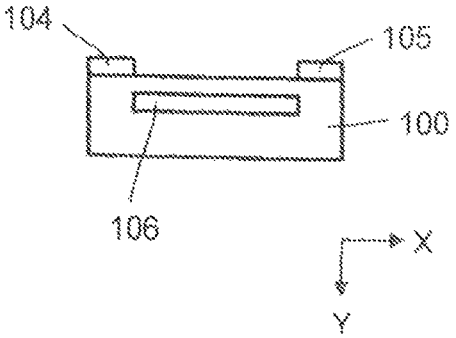

Potassium tantalum niobium oxide crystal (refractive index $n_2$=2.2000) was used as the dielectric material, and a waveguide-path part having a refractive index $n_1$ of 2.20132 by applying an electric field to a central portion, and both outer parts, were configured, for example, by adopting a sandwich structure shown in FIG. 11 or a planar structure shown in FIG. 12 for electric field application electrodes. The width of the waveguide-path was set to be 68.181 mm, and the interval P (=λ/2) between the electrodes was set to be 6.818 mm.

Further, when the fundamental wave $f_1$ was set to be 10 GHz and $c_0$ was set to be 3.00E+08 m/s, the propagation velocity $v_1$ (=$c_0/n_1$) in the waveguide-path was 1.36282E+08 m/s, the propagation velocity $v_2$ (=$c_0/n_2$) outside of the waveguide-path was 1.36364E+08 m/s, and $\alpha_s$(=$n_2/n_1$) was set to be 0.9994.

An electromagnetic wave having a wavelength $\lambda_1$ (=$v_1/f_1$) of 13.636 mm could be propagated.

Each of FIGS. 11(*a*) and 11(*b*) shows an example of a KTN crystal 100 having a positive electric field application electrode 101, a negative electric filed application electrode 102, and an electromagnetic wave guide electrode 103.

Each of FIGS. 12(*a*) and 12(*b*) shows another example of the KTN crystal 100 having a positive electric field application electrode 104, a negative electric filed application electrode 105, and electromagnetic wave guide electrodes 106.

DESCRIPTION OF REFERENCE NUMERALS

10: waveguide
11: dielectric
12, 13: input electrode
22, 23: output electrode

The invention claimed is:

1. A dielectric waveguide-path device for propagating an electromagnetic wave in GHz frequency in which a waveguide-path is configured of a dielectric material having a planar or circular cross-section shape, and when the electromagnetic wave travelling direction of the waveguide-path is set to be a Z direction and directions perpendicular to the Z direction and perpendicular to each other are set to be an X direction and a Y direction, a refractive index of the dielectric material of the waveguide-path is larger than a refractive index of a medium outside the waveguide-path, wherein an inner region of waveguide-path has slow electromagnetic wave propagation velocity, compared to a fast wave propagation velocity outside the waveguide path, where the maximum dimension in the X direction or the Y direction of the waveguide-path is specified by formula 1, wherein the formula 1 is $$\tan(k_s a/2)=k_f/k_s, \text{ or}$$

$$\tan(k_s a/2)=-k_s/k_f$$

wherein the former expression is an expression when the electromagnetic wave is propagated in a cosine (cos) distribution, and the latter expression is an expression when the electromagnetic wave is propagated in a sine (sin) distribution, $k_s$ is propagation constant of an electromagnetic wave in the slow-wave region, $k_f$ is propagation constant of an electromagnetic wave in the fast-wave region, and a is maximum dimension in the X direction or the Y direction of the waveguide-path, whereby an electric field has a lateral vibration mode curve that is inherent in the waveguide-path and the electric field has an attenuation curve outside of the waveguide-path are continuous on a surface of both sides of waveguide-path in the X direction or the Y direction, the electromagnetic wave in a lateral vibration mode of the electric field is transmitted in the form of the cosine distribution or the sine distribution in the Z direction while being totally reflected by the surface of both sides in the X direction or the Y direction of the waveguide-path, the waveguide-path has an output electrode structure in which a plurality of electrodes extending in the X direction or the Y direction are arranged at regular intervals with respect to the Z direction, inside the waveguide-path or on the surface thereof, wherein an interval in the Z direction of the plurality of electrodes is an interval of ½ of a wavelength in the electromagnetic wave travelling direction Z, which is determined by properties of the dielectric material and the maximum dimension in the X direction or the Y direction of the waveguide-path, and the dielectric waveguide-path device is made such that an electric signal is output from between the electrodes adjacent to each other.

2. A dielectric waveguide-path device for propagating an electromagnetic wave in GHz frequency in which a waveguide-path is configured of a dielectric material having a planar or circular cross-section shape, and when the electromagnetic wave having a travelling direction in the waveguide-path is set to be a Z direction and directions perpendicular to the Z direction and perpendicular to each other are set to be an X direction and a Y direction, a refractive index of the dielectric material of the waveguide-path is larger than a refractive index of a medium outside the waveguide-path, wherein an inner region of waveguide-path has a slow electromagnetic wave propagation velocity, compared to a fast wave propagation velocity in a region outside the waveguide-path, where the maximum dimension in the X direction or the Y direction of the waveguide-path is specified by formula 1, wherein the formula 1 is $$\tan(k_s a/2)=k_f/k_s, \text{ or}$$

$$\tan(k_s a/2)=-k_s/k_f$$

wherein the former expression is an expression when the electromagnetic wave is propagated in a cosine (cos) distribution, and the latter expression is an expression when the electromagnetic wave is propagated in a sine (sin) distribution, $k_s$ is propagation constant of the electromagnetic wave in the slow-wave region, $k_f$ is propagation constant of the electromagnetic wave in the fast-wave region, and a is maximum dimension in the X direction or the Y direction of the waveguide-path, whereby an electric field has a lateral vibration mode curve that is inherent in the waveguide-path and the electric field has an attenuation curve outside of the waveguide-path are continuous on a surface both sides of the waveguide-path in the X direction or the Y direction, the electromagnetic wave in the lateral vibration mode of the electric field is transmitted in the form of the cosine distribution or the sine distribution in the Z direction while being totally reflected by the surface of both sides in the X direction or the Y direction of the waveguide-path, and the waveguide-path has an input electrode structure in which a plurality of electrodes extending in the X direction or the Y direction are arranged at regular intervals with respect to the Z direction, inside the waveguide-path or on the surface of the waveguide-path, wherein the interval in the Z direction of the plurality of electrodes is an interval of ½ of a wavelength in the electromagnetic wave travelling direction Z, wherein the wavelength is determined by properties of the dielectric material and the maximum dimension in the X direction or the Y direction of the waveguide-path, and the dielectric waveguide-path device is made such that a high-frequency current is applied between the electrodes adjacent to each other.

3. The dielectric waveguide-path device according to claim 2, wherein an outer peripheral shape of the plurality of electrodes has a rectangular shape.

4. The dielectric waveguide-path device according to claim 2, wherein an outer peripheral shape of the plurality of electrodes satisfies formula 2, where, the formula 2 is $$T_n = \frac{\int_{-\frac{a}{2}}^{\frac{a}{2}} f(x)G_n(x)\,dx}{\sqrt{\int_{-\frac{a}{2}}^{\frac{a}{2}} f^2(x)\,dx}\sqrt{\int_{-\frac{a}{2}}^{\frac{a}{2}} G_n^2(x)\,dx}}$$

wherein $T_n$ is conversion efficiency from an outer peripheral shape f(x) of the electrode to an electromagnetic wave having an n-th order electric field lateral vibration mode distribution $G_n(x)$, or conversion efficiency from the electromagnetic wave having an n-th order electric field lateral vibration mode distribution $G_n(x)$ to a high-frequency current which is induced in the electrodes having the outer peripheral shape f(x), a is maximum dimension in the X direction and/or the Y direction of the waveguide-path, and x is coordinate in the X direction and/or the Y direction of the waveguide-path with a waveguide-path middle position as origin.

5. The dielectric waveguide-path device according to claim 2, wherein the dielectric has a rectangular shape, a circular shape, or an elliptical shape in cross-section.

* * * * *